US006225964B1

(12) United States Patent
Fermelia et al.

(10) Patent No.: US 6,225,964 B1
(45) Date of Patent: May 1, 2001

(54) DUAL GRIDDED REFLECTOR ANTENNA SYSTEM

(75) Inventors: Louis Rudolph Fermelia; Parthasarathy Ramanujam, both of Redondo Beach; Brian M. Park, Torrance, all of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/328,769

(22) Filed: Jun. 9, 1999

(51) Int. Cl.[7] ..... H01Q 15/02; H01Q 19/10
(52) U.S. Cl. ..... 343/909; 343/756; 343/781 P
(58) Field of Search ..... 343/909, 756, 343/781 P, 781 R, 781 CA; H01Q 15/02, 19/10

(56) References Cited

U.S. PATENT DOCUMENTS 3,096,519 * 7/1963 Martin ..... 343/756
3,271,771 * 9/1966 Hannan et al. ..... 343/756
3,281,850 * 10/1966 Hannan ..... 343/756
3,797,020 * 3/1974 Roger et al. ..... 343/756
4,335,387 * 6/1982 Salvat et al. ..... 343/756

* cited by examiner

*Primary Examiner*—Hoanganh Le
(74) *Attorney, Agent, or Firm*—T. Gudmestad

(57) ABSTRACT

An antenna system comprising a first reflector and a second reflector is disclosed. The first reflector reflects an incident signal from a signal source. The incident signal comprises a first signal having a first polarization and a second signal having a second polarization. The first reflector has a surface that reflects the first signal and the second signal. The second reflector receives the reflected incident signal from the first reflector and comprises a first reflective surface for reflecting the first signal and a second reflective surface for reflecting the second signal.

22 Claims, 10 Drawing Sheets

DUAL GRIDDED REFLECTOR ANTENNA SYSTEM

CROSS-REFERENCE TO RELATED APPLICATIONS

This application is related to U.S. patent application Ser. No. 09/119,301, entitled "METHOD FOR REDUCING CROSS-POLAR DEGRADATION IN MULTI-FEED DUAL OFFSET REFLECTOR ANTENNAS," filed on Jul. 20, 1998, by Parthasarathy Ramanujam, et al., which application is incorporated by reference herein.

BACKGROUND OF THE INVENTION

1. Field of the Invention

This invention relates in general to antenna systems, and in particular to a dual gridded reflector antenna system.

2. Description of Related Art

Communications satellites have become commonplace for use in many types of communications services, e.g., data transfer, voice communications, television spot beam coverage, and other data transfer applications. As such, satellites must provide signals to various geographic locations on the Earth's surface. As such, typical satellites use customized antenna designs to provide signal coverage for a particular country or geographic area.

In order to provide good cross-polarization performance over the geographic region of interest, a shaped dual reflector geometry is often used. The subreflector and/or main reflector is then shaped to generate a beam pattern that covers the intended coverage geographic region.

An advantage of dual reflector designs is that the main reflector is thin and therefore generally easy to package and stow in the confines of the launch vehicle volume constraints. A typical dual reflector antenna system can provide one beam for each of two linear polarizations. However, typical dual reflector antenna systems have a main reflector that has only one solid surface, and therefore can generate only one distinct beam shape.

Alternately, a "dual-gridded" shaped reflector system may be used to produce beams over the desired coverage area. This type of antenna system is a shared aperture system having two separate reflective surfaces, one reflective surface for each polarization. Each reflective surface, also called a "front shell" and a "rear shell," may be shaped to produce a distinct beam shape for each polarization. The cross-polarization performance is a function of both the front and rear shell geometry. To provide adequate cross-polarization performance, the two focal points must be separated. The resulting reflector shell becomes large and thick, and therefore difficult to package and stow within the confines of the launch vehicle constraints. The use of multiple antennas can also produce multiple beam patterns, however, multiple antennas within a system also produce space and deployment problems for the satellite and make it difficult to design the satellite to fit within the launch vehicle volume constraints.

It can be seen, then, that there is a need in the art for antenna reflectors that provide multiple distinctly shaped beams. It can also be seen that there is a need in the art for antenna systems that provide distinctly shaped beams for multiple polarizations that are easy to stow within launch vehicle constraints.

SUMMARY OF THE INVENTION

To overcome the limitations in the prior art described above, and to overcome other limitations that will become apparent upon reading and understanding the present specification, the present invention discloses a dual-gridded reflector antenna system that allows multiple beams to be formed by the reflector surfaces. An antenna system in accordance with the present invention comprises a first reflector and a second reflector. The first reflector reflects an incident signal from a signal source. The incident signal comprises a first signal having a first polarization and a second signal having a second polarization. The first reflector has a surface that reflects the first signal and the second signal. The second reflector receives the reflected incident signal from the first reflector and comprises a first reflective surface for reflecting the first signal and a second reflective surface for reflecting the second signal.

An object of the present invention is to provide an antenna system that provides distinctly shaped beams that are easy to stow within launch vehicle constraints. Another object of the present invention is to provide an antenna system that provides distinctly shaped beams for multiple polarizations that are easy to stow within launch vehicle constraints.

BRIEF DESCRIPTION OF THE DRAWINGS

Referring now to the drawings in which like reference numbers represent corresponding parts throughout:

FIGS. 4A–4B illustrate the cross-polarization performance for each of the orthogonally polarized beams shown in FIGS. 3A–3B;

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Overview

The present invention incorporates the desirable properties of a purely dual reflector antenna system and the desirable properties of a purely dual-gridded antenna system while avoiding the limitations of both systems. The present invention comprises a solid subreflector and a shaped "dual-gridded" main reflector, which allows a distinctly shaped beam for each orthogonal linear polarization used with the antenna system.

The present invention employs the small packaging size of a conventional system with the flexibility of a dual-gridded system to provide four or more beams from a single satellite that can be launched within launch vehicle constraints. The antenna of the present invention results in simpler packaging and a higher performance, lower cost satellite.

The present invention benefits all future multi-beam (multi-coverage) satellites that operate at multiple polarizations. The present invention provides an improved approach by accommodating large aperture antennas capable of producing distinct beam shapes for each orthogonal polarization.

The present invention enables communications services that are either impossible with conventional techniques, or are prohibitively expensive using conventional techniques. For example, Direct-To-Home (DTH) systems that provide local-to-local services are possible using the present invention.

The present invention does not require new gridding technology, nor does the present invention require precision alignment of the subreflector and main reflector surfaces. The present invention is easier to align compared to dual gridded single reflector systems, and uses the polarizations of the signals to align to the proper main reflector surface. Further, the subreflector and feed are identical to those used in conventional dual reflector systems, providing the present invention ease of integration into the satellite.

The main reflector of the present invention comprises two closely separated gridded surfaces. Since the subreflector is solid the alignment is no more rigorous than that required for conventional DGS systems.

Beam Pattern Requirements

Figure 1:
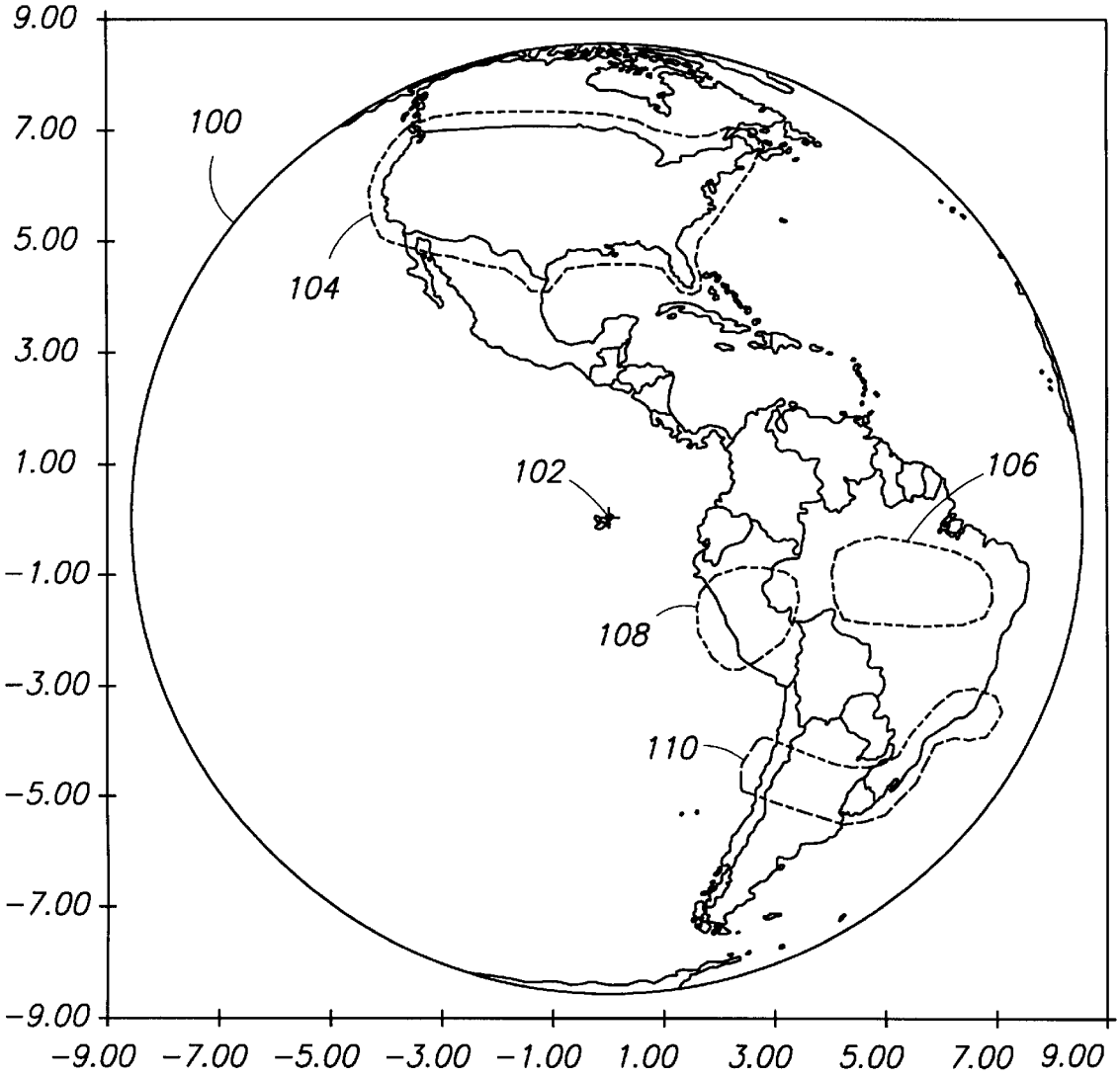
FIG. 1 illustrates a typical satellite perspective of the Earth with multiple desired beam patterns.

FIG. 1 illustrates a typical satellite perspective of the Earth with multiple desired beam patterns. Earth 100 is shown from the perspective of a satellite, typically a satellite in geosynchronous orbit. Boresight 102 is indicated to illustrate the desired pointing angle of the satellite. The satellite provides communications signals, called beams, that provide the proper signal strength to communicate with antennas on the Earth's 100 surface. However, because of power limitations, desired coverage areas, etc., a single antenna cannot provide coverage for the entire visible portion of the Earth's 100 surface. Specific geographic areas are selected by the satellite designer for communications coverage. The satellite typically provides communications services in one or more selected geographic areas by using multiple antenna beams. Beams 104–110 are indicated as covering four distinct geographic areas on the Earth's 100 surface within the Western Hemisphere, as shown in FIG. 1.

In order to generate beams 104–110, present techniques employ multiple antennas, i.e., three or four antennas with apertures of 100 inches and more, to generate the beams 104–110. However, satellites and launch vehicles can not always accommodate four antennas with apertures of this diameter, and, as such, the satellite either cannot provide the coverage shown by beams 104–110, or multiple satellites must be launched to provide the beams 104–110. A single satellite using two dual-gridded shaped reflectors might be able to provide beams 104–110, but other constraints on the satellite, e.g., power, weight, size, and launch vehicle size constraints would typically limit the satellite to fewer than four beams 104–110. Further, the bulky shape of typical dual-gridded antenna systems makes the design of the satellite increasingly more difficult. Alternatively, an all "conventional Gregorian" antenna system can yield two beams 104–110, e.g., 104 and 106, and a second satellite would have to be launched to provide beams 108–110. The extra expense of multiple satellites, as well as the design costs of packaging and designing a dual-gridded system that could provide more than two beams 104–110, makes the cost of communications services prohibitively expensive.

Many applications, e.g., those that require beam 104–110 coverage of specific geographic areas, require the use of multiple beams 104–110 that emanate from a single antenna reflector. The need for multiple beams 104–110 is especially pronounced in systems that operate with frequency reuse. Synthesis of multiple beams using a single antenna reflector requires the use of dual polarization reflector antennas. Dual polarization reflector antennas can be implemented using dual gridded reflectors or multiple reflectors. Dual gridded reflectors use two orthogonally polarized reflector surfaces that are fed individually by a single feed or an array of feeds. The two reflector surfaces may be parabolic or specially shaped.

Antenna System Diagram

Figure 2:
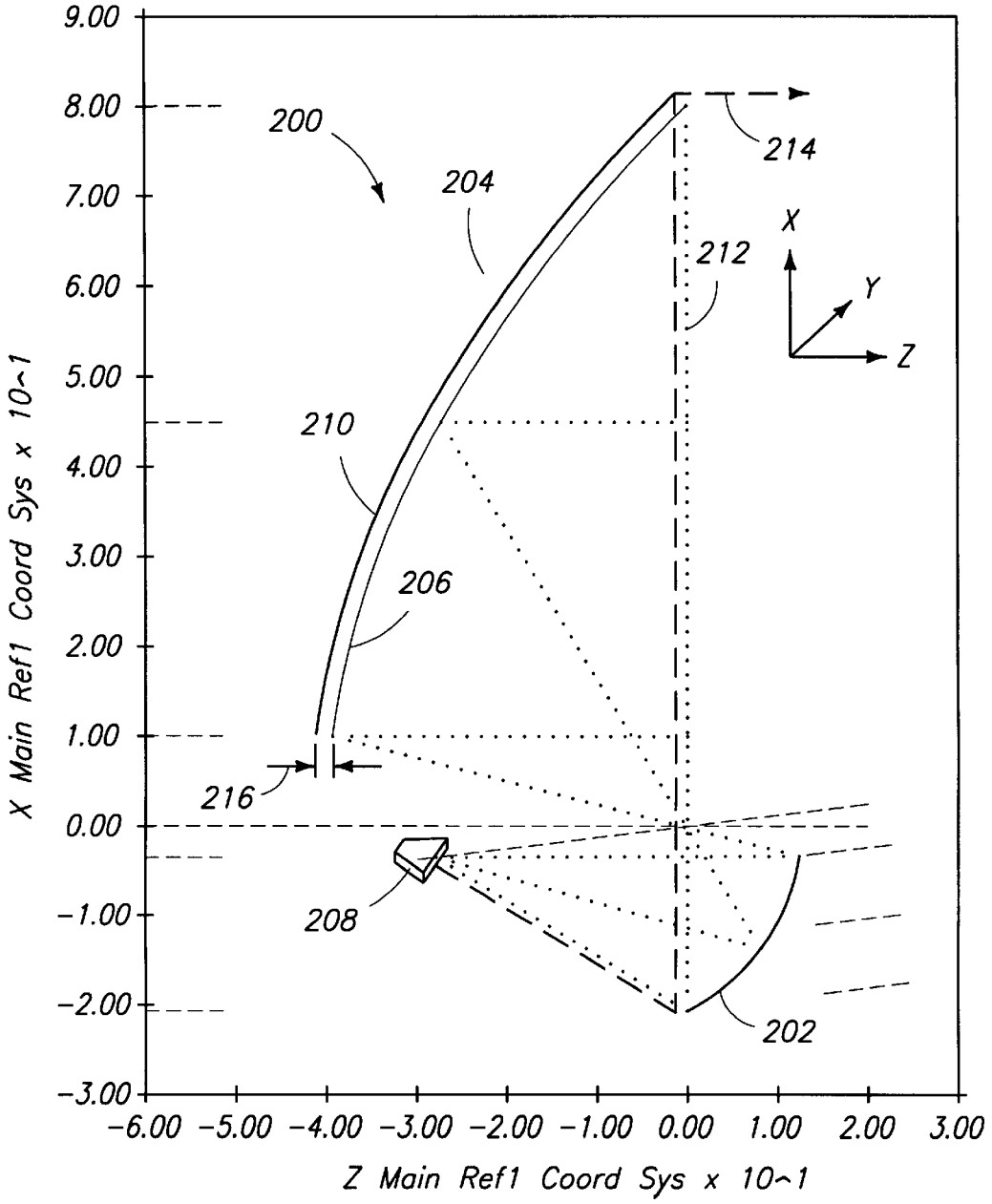
FIG. 2 illustrates the antenna system of the present invention.

FIG. 2 illustrates the antenna system 200 of the present invention.

The antenna system 200 is a dual reflector design utilizing a subreflector 202 and a dual gridded main reflector 204 comprising two reflective surfaces. The surface of subreflector 202 reflects incoming signals of all polarizations. The first reflective surface 206 reflects a signal from the feed horn 208 at a first polarization and the second reflective surface 210 reflects a signal from the feed horn 208 at a second polarization.

Typically, the reflective surfaces 206 and 210 are designed to reflect orthogonally polarized signals 212 and 214, e.g., horizontal and vertical polarized signals, right and left hand circularly polarized signals, etc. However, the reflective surfaces 206 and 210 can be utilized with non-orthogonally polarized signals without departing from the scope of the present invention, e.g., horizontally linearly polarized signal 212 and right hand circularly polarized signal 214 can be used without departing from the scope of the present invention.

Dual reflector systems typically utilize a main reflector 204 and a subreflector 202. Two common configurations of dual reflector antenna systems are known as "Gregorian" and "Cassegrain." Typically, the main reflector 204 is specifically shaped or parabolic and the subreflector 202 is ellipsoid in shape for a Gregorian configuration or hyperboloid in shape for a Cassegrain configuration, but may be specially shaped as well. In typical dual reflector systems neither the main reflector 204 nor the subreflector 202 are polarized and, therefore, the main reflector 204 and the subreflector 202 reflect all polarizations of incident signals 212 and 214 from the feed horn 208.

Copolarization and Cross-Polarization

As shown in FIG. 2, each polarization surface 206 and 210 is designed to only reflect one polarization of incident signals (electromagnetic energy) 212 and 214. Therefore, the polarization purity of the radiation pattern produced by the antenna system 200 is achieved through the use of the two polarized surfaces 206 and 210. Surfaces 206 and 210 are typically orthogonally polarized, but are not required to be orthogonally polarized. The polarized surfaces 206 and 210 share a common projected aperture and the feed horn 208 illuminates both of the surfaces 206 and 210. Each incident signal 212 and 214, even though orthogonally polarized, will reflect from the surface that the signal is designed to reflect from and the surface it is designed to avoid.

For example, a horizontal linear polarized signal 214 will reflect from both the horizontal polarized surface 206 and the vertical polarized surface 210. The reflection from the opposite polarized surface, e.g., surface 206, will be proportionately smaller, and will not reflect in the same direction as, the reflection from the proper polarized surface e.g., surface 210, but the reflection will still exist. The desired reflection is called "co-polarized" reflection, because the surface 210 and the incident signal 214 are of the same polarization. The reflection from the opposite polarized surface 206 is called "cross-polarized" reflection.

Typically, in dual-gridded systems, separating the opposite polarized surface's focal point from the desired polarized surface's focal point reflects the cross-polarized reflected signal to a different location than the co-polarized reflected signal. For multiple feed horn systems, the semi-parabolic geometry of the orthogonally polarized surfaces and the separation of the feeds also results in a separation distance 216 between the orthogonally polarized reflective surfaces 206 and 210. This separation distance 216 can become large in cases where there are large coverage areas, thereby inhibiting mechanical packaging in the launch envelope.

When two different polarizations are used on a dual reflector system, cross-polarization performance of the system is very important. Optimum cross-polarization performance may be achieved through the "Mitzuguchi condition" which is a relationship that governs the location of an antenna feed with respect to the main reflector and the subreflector focal axes. An ellipsoid dual-reflector antenna system satisfying the Mitzuguchi condition eliminates the cross-polarization component. By replacing the typical dual reflector system's main reflector with two orthogonally polarized surfaces, two orthogonal linear polarization beams can be produced, each one retaining high cross-polarization performance. Since the cross-polarization reflection is essentially absent with the present invention, there is no need to direct the cross-polarization reflection to a different geographic region, and thus, a wide separation 216 between the two orthogonal main reflector surfaces 206 and 210 and their respective focal points is not required. Each independent orthogonally polarized surface 206 and 210 can be parabolic or specially shaped to provide an independent and distinct beam shape for each polarization.

In the present invention, advantages over the conventional dual gridded reflector system are realized in that the dual polarized surfaces 206 and 210 need a separation distance 216 that is only large enough to accommodate the variation in the shapes of the two surfaces 206 and 210. The offset of the focal points of surfaces 206 and 210 is not required as in other dual-gridded systems, which reduces the bulk of the main reflector 204 and allows two independent and distinct beam shapes with one feed horn. Additionally, the antenna system 200 of the present invention can use more than one feed horn 208, or even a feed horn 208 array, to illuminate the antenna system 200 and produce multiple orthogonal linearly polarized beams.

Illustration of Co-polarization and Cross-polarization

FIGS. 3A–3B and 4A–4B illustrate performance data for co-polarized and cross-polarized signals from an antenna system in accordance with the present invention.

Figure 3A:
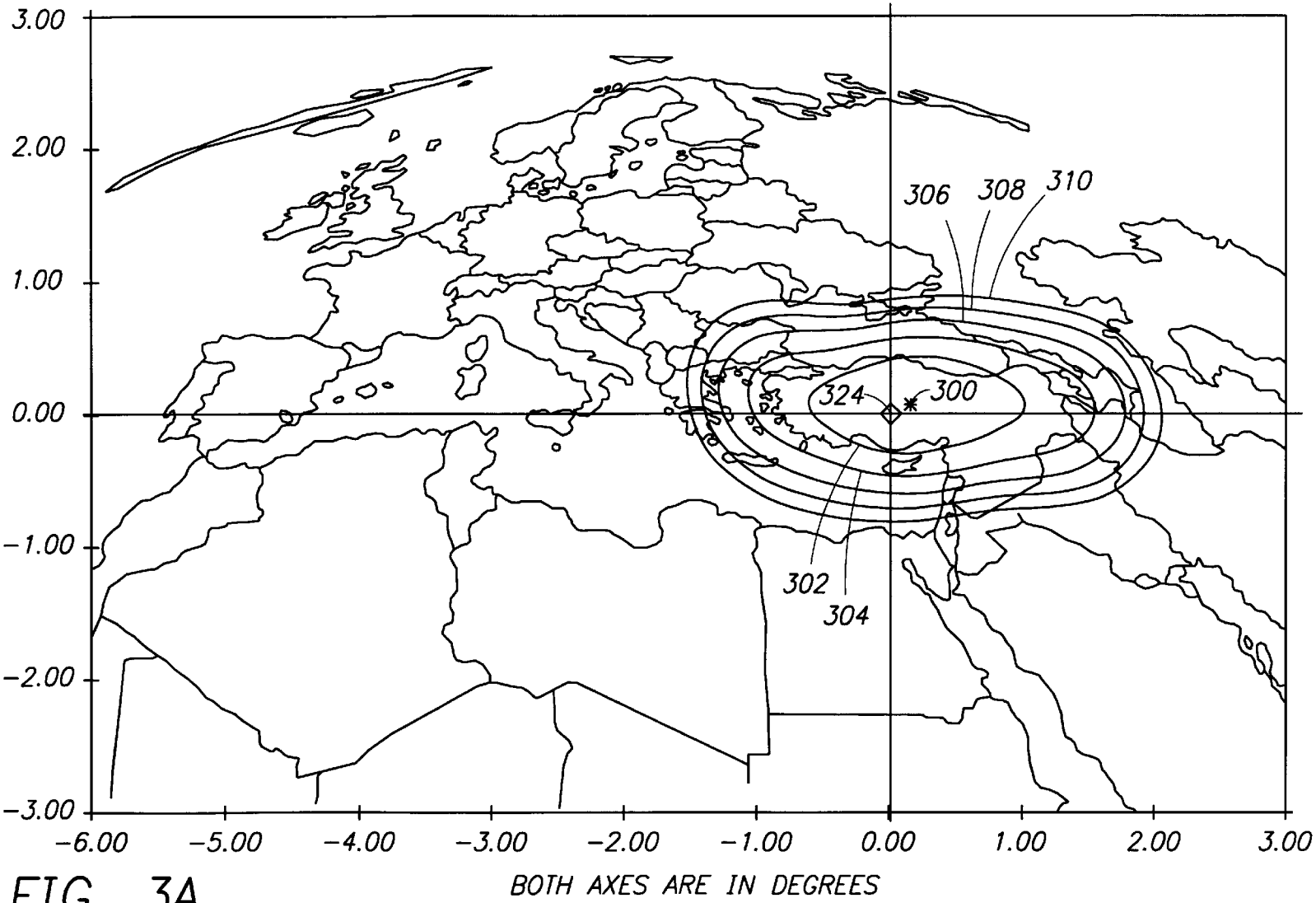
FIGS. 3A–3B and 4A–4B illustrate performance data for co-polarized and cross-polarized signals from an antenna system in accordance with the present invention.
Figure 3B:
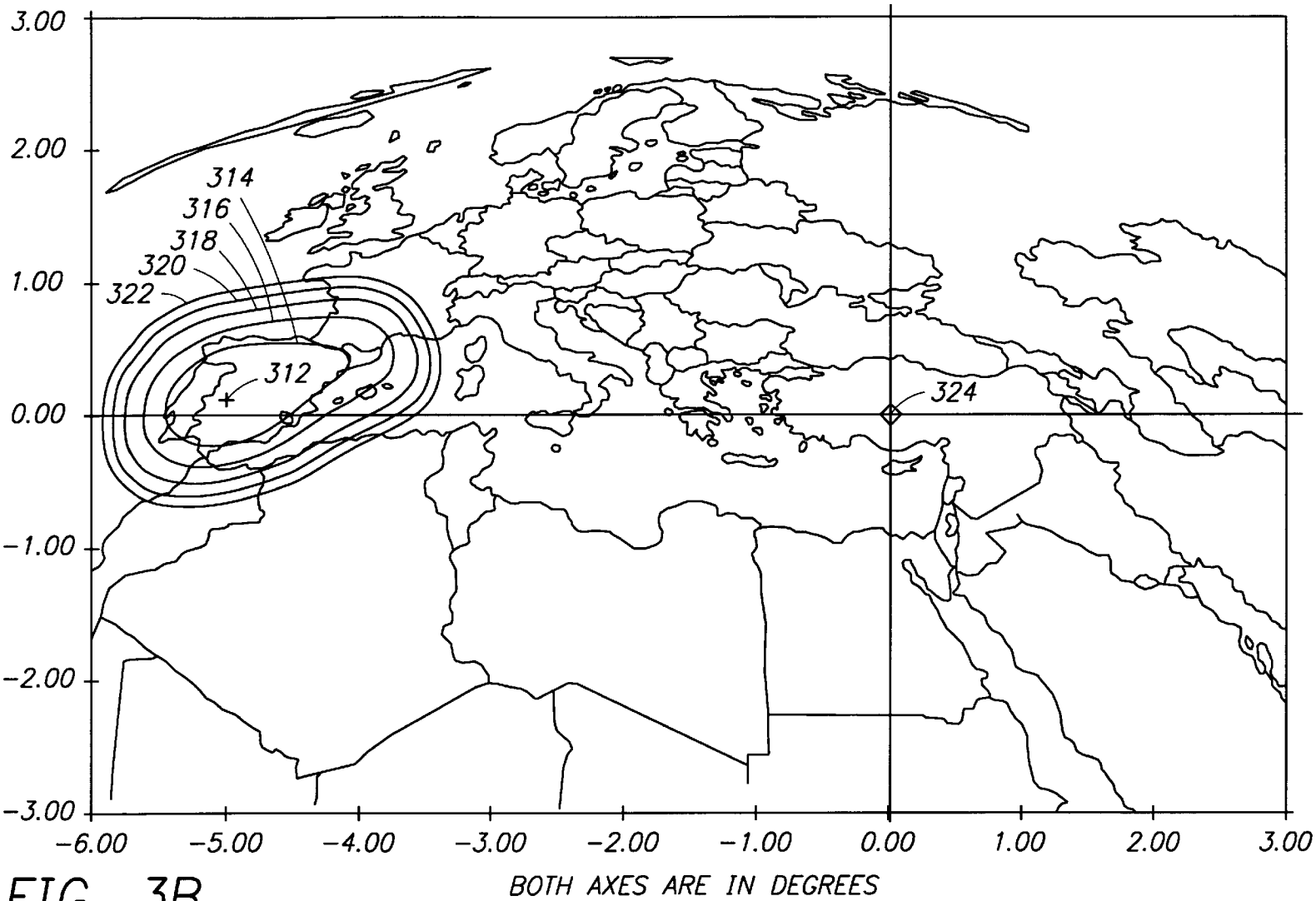

FIGS. 3A–3B show typical co-polarized performance for each of the orthogonally polarized beams produced by the antenna described in the invention. The beam shapes are independent and distinct for each polarization. In this example the dual reflector system 200 uses an ellipsoidally shaped subreflector 202 geometry with a seventy inch main reflector 204 operating at 12.2 gigahertz (GHz). FIG. 3A illustrates beam coverage over a geographic region centered at point 300. The peak performance of the beam at point 300 is 38.15 dB. The beam is produced using a main reflector 204 surface 210 that has a focal length of 45 inches and is co-polarized in the y-direction. Lines 302–310 indicate the signal strength of the beam at geographical regions that surround point 300. Line 302 indicates the geographic region where a 1 dB drop in signal strength occurs, e.g., the signal strength at geographic locations located on line 302 is approximately 37.15 dB. Line 304 indicates the geographic region where a 2 dB drop in signal strength occurs, e.g., the signal strength at geographic locations located on line 304 is approximately 36.15 dB. Line 306 indicates the geographic region where a 3 dB drop in signal strength occurs, e.g., the signal strength at geographic locations located on line 306 is approximately 35.15 dB. Line 308 indicates the geographic region where a 4 dB drop in signal strength occurs, e.g., the signal strength at geographic locations located on line 308 is approximately 34.15 dB. Line 310 indicates the geographic region where a 5 dB drop in signal strength occurs, e.g., the signal strength at geographic locations located on line 310 is approximately 33.15 dB.

FIG. 3B illustrates a beam produced using a main reflector 204 surface 206 that has a focal length of 49 inches and is polarized in the x-direction. The peak performance is shown at point 312, where the signal strength is approximately 40.68 dB. Lines 314–322 indicate the signal strength of the beam at geographical regions that surround point 312. Line 314 indicates the geographic region where a 1 dB drop in signal strength occurs, e.g., the signal strength at geographic locations located on line 314 is approximately 39.68 dB. Line 316 indicates the geographic region where a 2 dB drop in signal strength occurs, e.g., the signal strength at geographic locations located on line 316 is approximately 38.68 dB. Line 318 indicates the geographic region where a 3 dB drop in signal strength occurs, e.g., the signal strength at geographic locations located on line 318 is approximately 37.68 dB. Line 320 indicates the geographic region where a 4 dB drop in signal strength occurs, e.g., the signal strength at geographic locations located on line 302 is approximately 36.68 dB. Line 322 indicates the geographic region where a 5 dB drop in signal strength occurs, e.g., the signal strength at geographic locations located on line 322 is approximately 35.68 dB.

The beam coverage shown in FIGS. 3A and 3B are generated simultaneously. The satellite pointing direction is indicated at point 324. Point 300 is approximately 0.25 degrees from the satellite pointing direction point 324, whereas point 312 is approximately 5 degrees off of satellite pointing direction point 324.

Figure 4A:
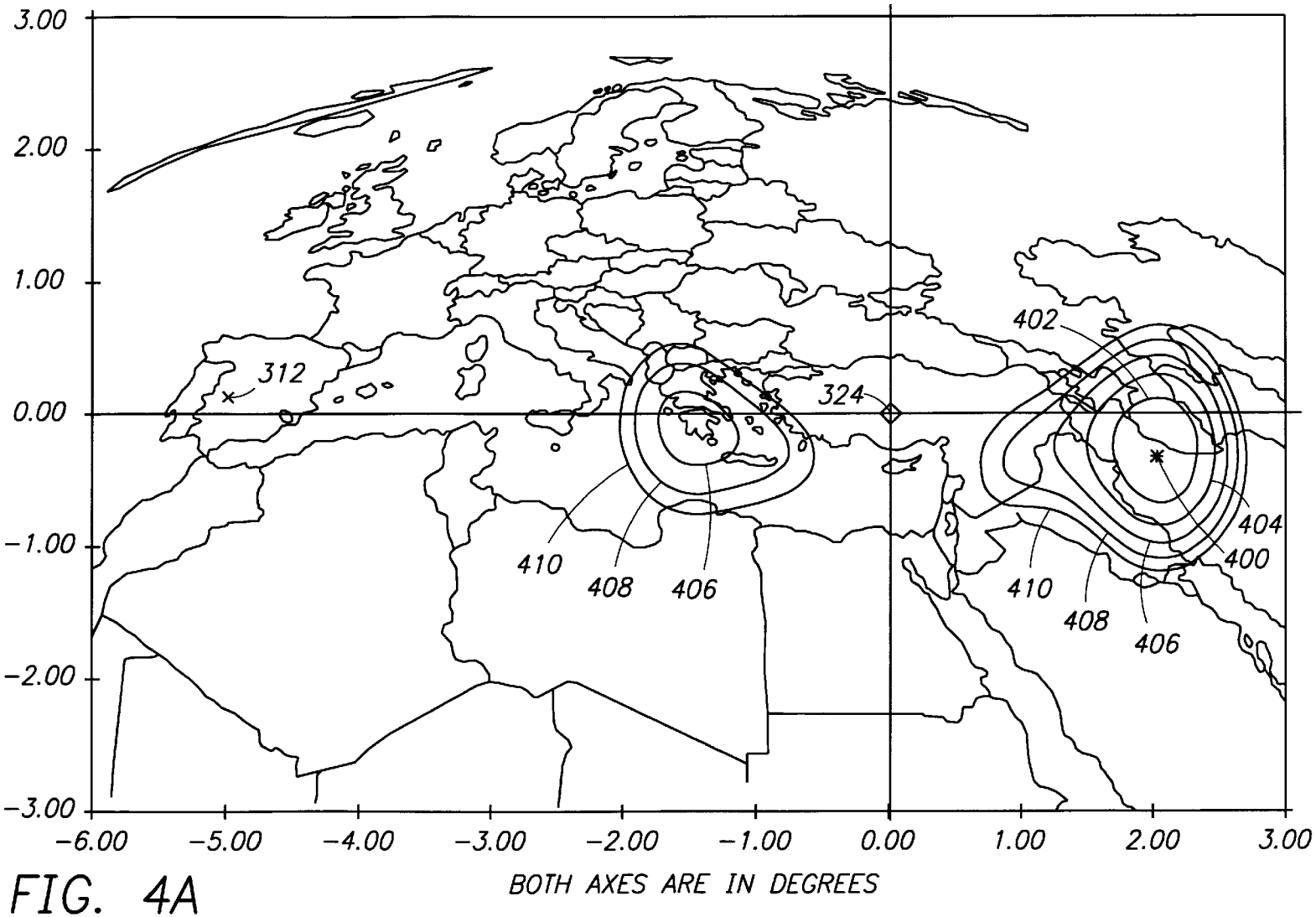
Figure 4B:
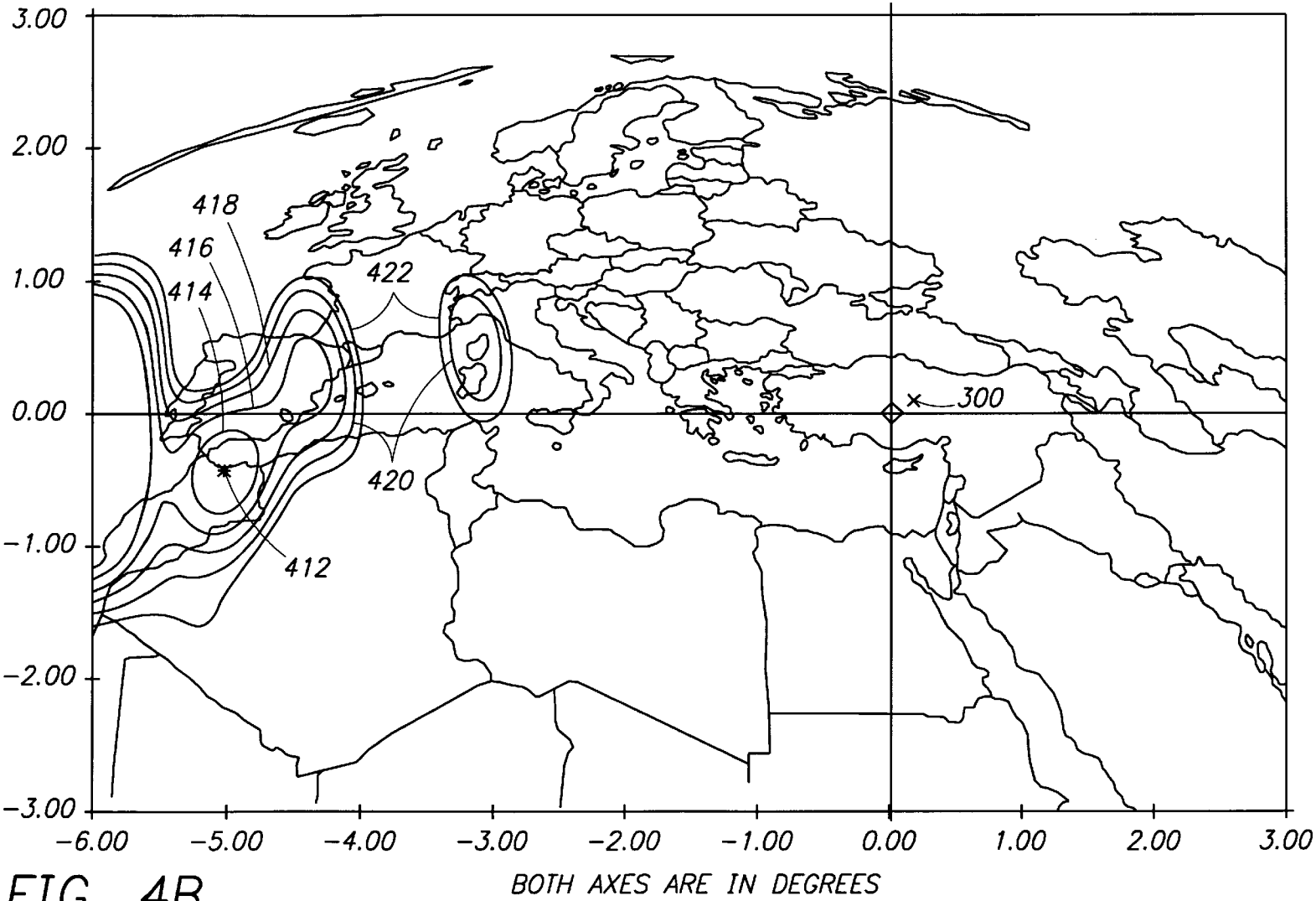

FIGS. 4A–4B illustrate the cross-polarization performance for each of the orthogonally polarized beams shown in FIGS. 3A–3B.

FIG. 4A illustrates the cross-polarization beam produced using a main reflector 204 surface that has a focal length of 45" and is co-polarized in the y-direction, e.g., the beam pattern shown in FIG. 4A is generated by the signal 212 that is reflecting from the surface 210. The beam pattern shown in FIG. 4A is the cross-polarization for the signal 212 that is designed to have a maximum signal strength at point 312.

The maximum cross-polarization signal strength is shown at point 400, where the signal strength is −0.21 dB, which is 41 dB less than the maximum signal strength location at point 312. Lines 402–410 indicate the signal strength of the beam at other geographical regions.

FIG. 4B illustrates the cross-polarization beam is produced using a main reflector surface that has a focal length of 49" and is polarized in the x-direction, e.g., the beam pattern shown in FIG. 4B is generated by the signal 214 that is reflecting from the surface 206. The beam pattern shown in FIG. 4A is the cross-polarization for the signal 214 that is designed to have a maximum signal strength at point 300.

The maximum cross-polarization signal strength is shown at point 412, where the signal strength is −27.50 dB, which is 65 dB less than the maximum signal strength location at point 300. Lines 414–422 indicate the signal strength of the beam at other geographical regions.

Additional Design Features

Figure 5:
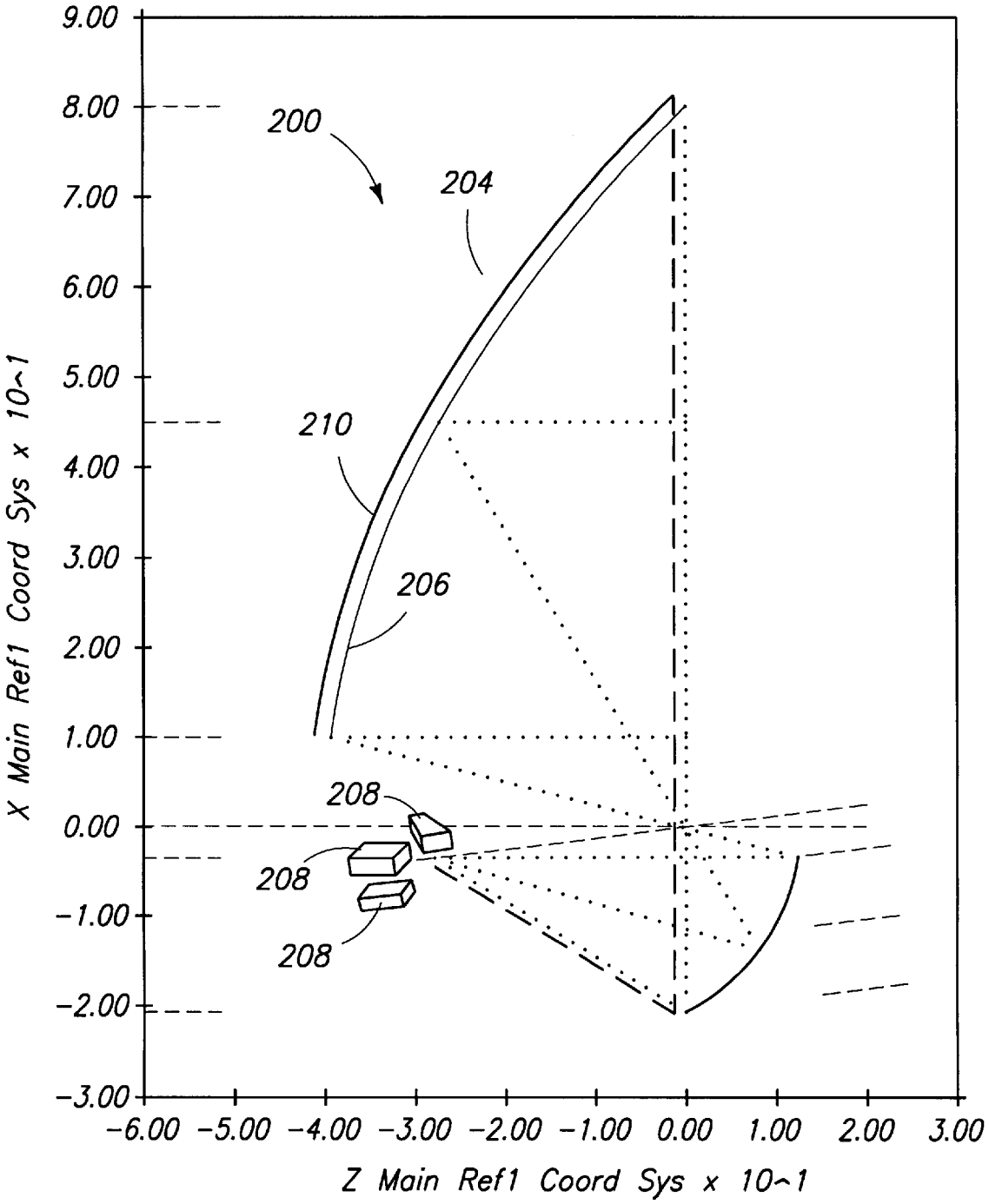
FIG. 5 shows the antenna system of the present invention having multiple feed horns.

FIG. 5 shows the antenna system of the present invention having multiple feed horns.

As discussed with respect to FIG. 2, antenna system 200 can have multiple feed horns 208 in order to illuminate subreflector 202 and main reflector 204. This design will allow antenna system 200 to produce two beams for every feed horn 208 within the antenna system 200, and, as such, each main reflector 204 can produce more than two beams for coverage regions on the Earth's surface. The number of beams is now limited by the number of feed horns 208 that can be properly positioned and powered by the satellite.

Figure 6:
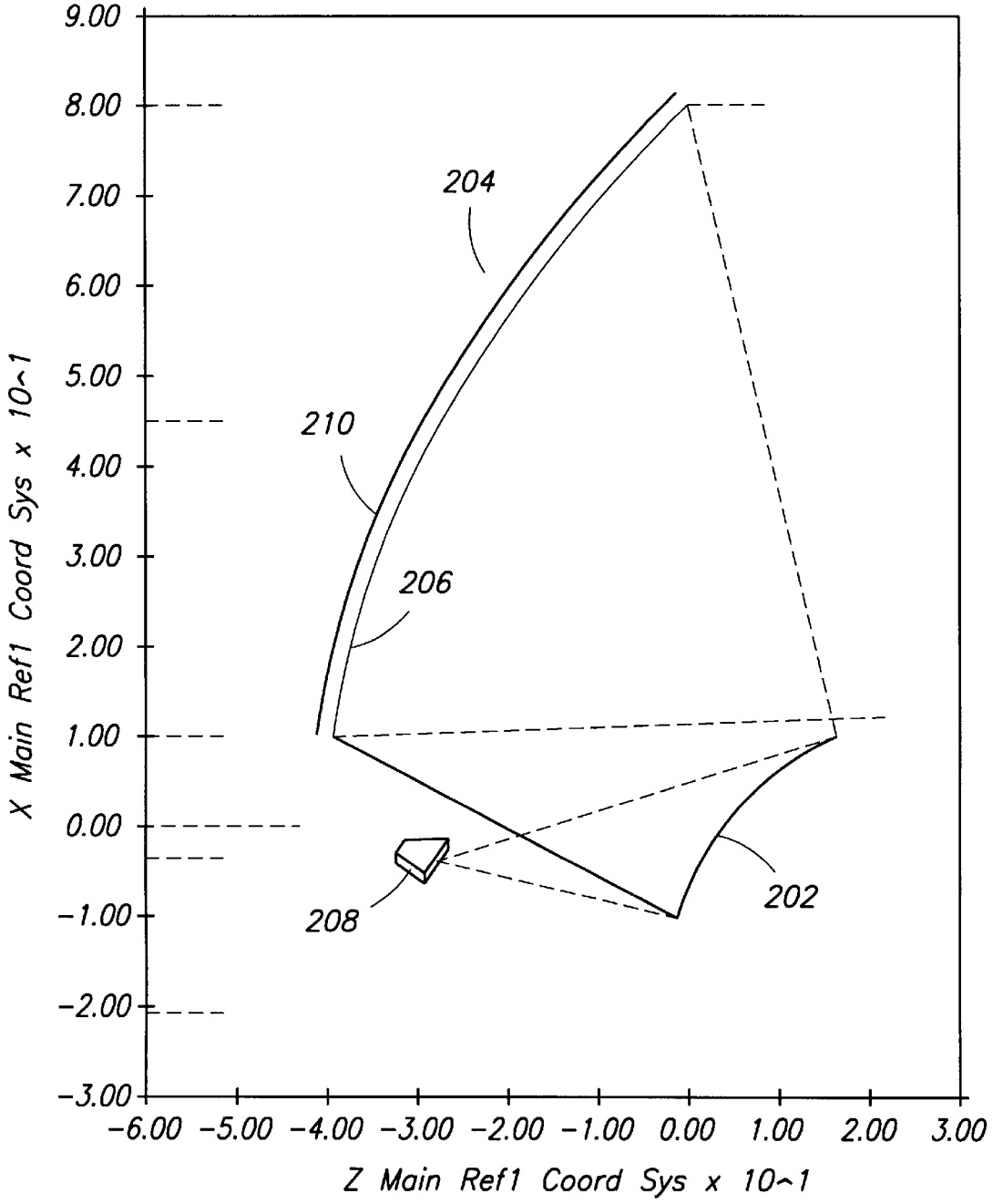
FIG. 6 shows an alternative embodiment of the antenna system of the present invention.

FIG. 6 shows an alternative embodiment of the antenna system of the present invention.

As shown in FIG. 6, the antenna system 200 of the present invention can have a different shaped subreflector 202, e.g., hyperboloid in geometry instead of ellipsoid in geometry as shown in FIG. 2. Thus, any dual-reflector antenna system 200 can benefit from the present invention.

Figure 7:
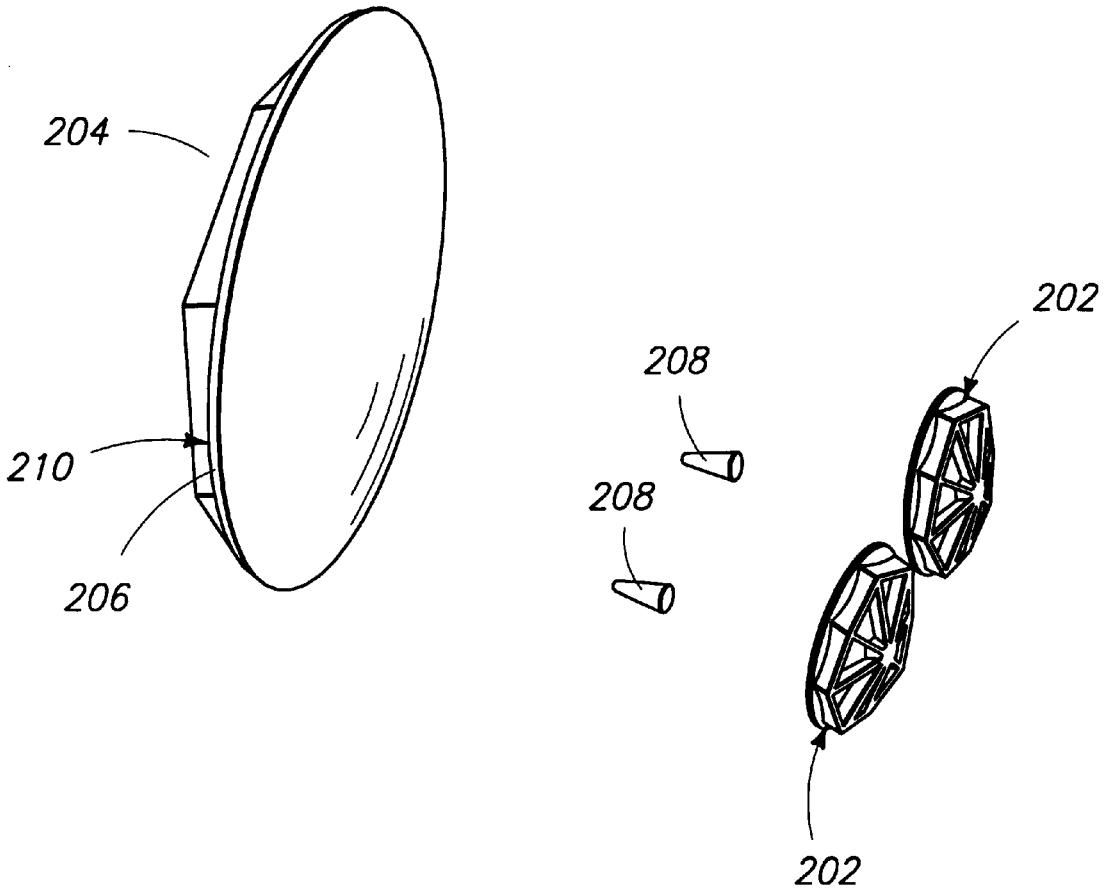
FIG. 7 illustrates an alternative embodiment of the present invention.

FIG. 7 illustrates an alternative embodiment of the present invention. Instead of a single subreflector 202, the present invention also envisions two separate subreflectors 202 that are positioned to reflect energy from separate feed horns 208 to main reflector 202. Each feed horn 208 can generate a signal that contains only one polarization, or can generate signals with two polarizations. With the system shown in FIG. 7, one of the subreflectors 202 can be moved with respect to the other subreflector 202, which allows the beams generated by one feed horn 208 to be moved and/or shaped, depending on the direction of motion of the subreflector 202. Further, the movement of subreflector 202 will move the beam generated by one polarization from feed horn 202 differently from the beam generated by the other polarization from feed horn 202, because of the different reflective surfaces 206 and 210 on main reflector 204.

Figure 8:
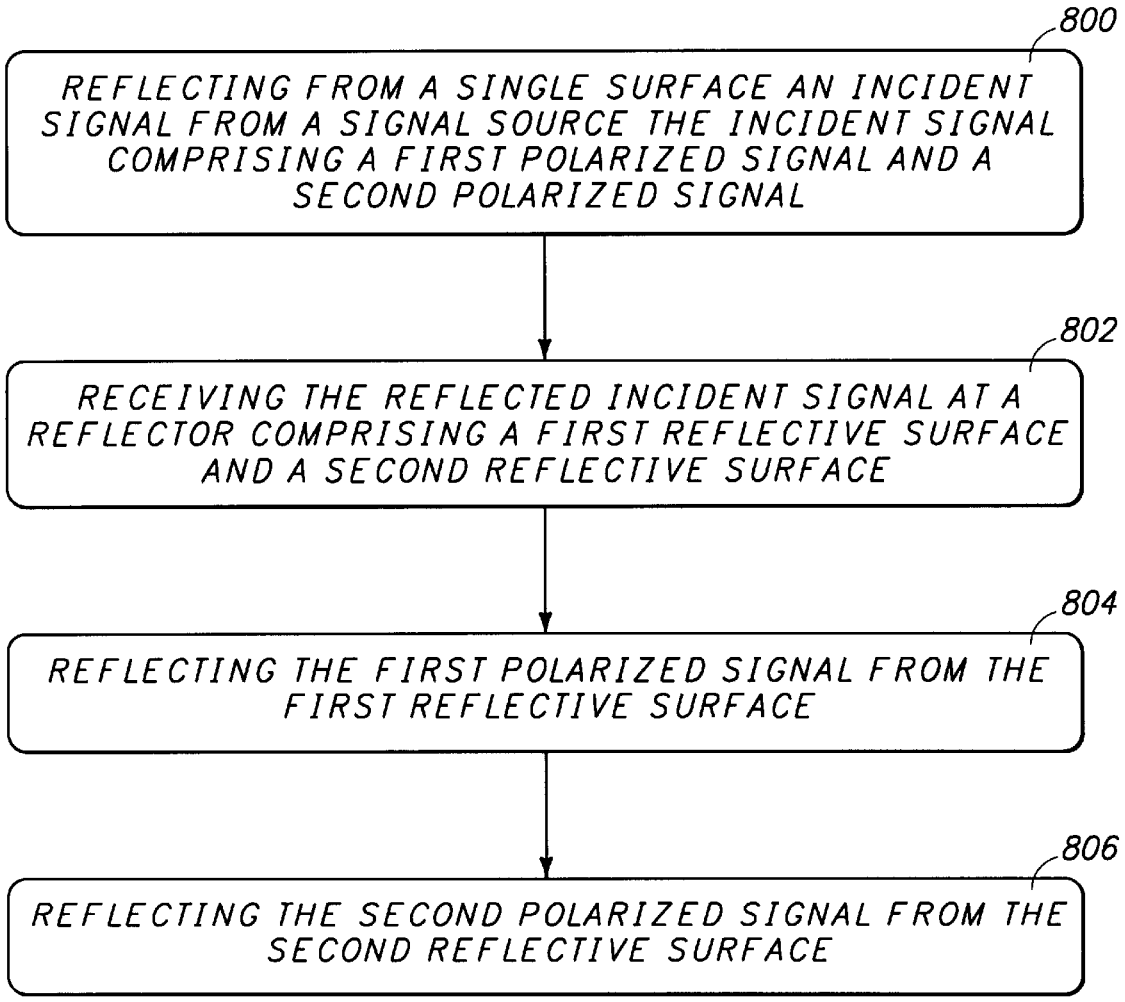
FIG. 8 is a flow chart illustrating the steps used to practice the present invention.

FIG. 8 is a flow chart illustrating the steps used to practice the present invention.

Block 800 illustrates performing the step of reflecting from a single surface an incident signal from a signal source, the incident signal comprising a first polarized signal and a second polarized signal.

Block 802 illustrates performing the step of receiving the reflected incident signal at a reflector comprising a first reflective surface and a second reflective surface.

Block 804 illustrates performing the step of reflecting the first polarized signal from the first reflective surface.

Block 806 illustrates performing the step of reflecting the second polarized signal from the second reflective surface.

This concludes the description of the preferred embodiment of the invention. The following paragraphs describe some alternative methods of accomplishing the same objects. The present invention, although described with respect to RF systems, can also be used with optical systems to accomplish the same goals. Further, multiple antenna systems 200 as described can reside on a single satellite, providing further flexibility in satellite design. Although the present invention is described with a main reflector 204 having two reflective surfaces 206 and 210 and a subreflector 202 that has a reflective surface that reflects signals of both polarizations, the present invention can be embodied where the subreflector 204 has two reflective surfaces, each surface of the subreflector 204 designed to reflect a specific polarization, and the main reflector 204 has a reflective surface that reflects signals of both polarizations. Alternatively, both the subreflector 202 and the main reflector 204 can have two reflective surfaces, wherein each surface of the subreflector 202 reflects one polarization, and each surface of the main reflector 204 reflects one polarization. As an example, the outer surface of the subreflector 202 reflects substantially horizontally polarized signals, the inner surface of the subreflector 202 reflects substantially vertically polarized signals, the outer surface of the main reflector 204 reflects substantially horizontally polarized signals, and the inner surface of the main reflector 204 reflects substantially vertically polarized signals. Either surface on either reflector 202 or 204 can be designed to reflect any polarization of signal.

In summary, the present invention discloses an antenna system comprising a first reflector and a second reflector. The first reflector reflects an incident signal from a signal source. The incident signal comprises a first signal having a first polarization and a second signal having a second polarization. The first reflector has a surface that reflects the first signal and the second signal. The second reflector receives the reflected incident signal from the first reflector and comprises a first reflective surface for reflecting the first signal and a second reflective surface for reflecting the second signal.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An antenna system, comprising:

a first reflector for reflecting an incident signal from a signal source, the incident signal comprising a first signal having a first polarization and a second signal having a second polarization, the first reflector having a surface that reflects the first signal and the second signal; and a second reflector for receiving the reflected incident signal from the first reflector, wherein the second reflector comprises a first reflective surface for reflecting the first signal and a second reflective surface for reflecting the second signal.

2. The antenna system of claim 1, wherein the surface of the first reflector is substantially ellipsoid in shape.

3. The antenna system of claim 1, wherein the surface of the first reflector is substantially hyperboloid in shape.

4. The antenna system of claim 1, wherein the first reflective surface of the second reflector is substantially paraboloid in shape.

5. The antenna system of claim 1, wherein the second reflective surface of the second reflector is substantially paraboloid in shape.

6. The antenna system of claim 5, wherein the first reflective surface of the second reflector is substantially paraboloid in shape.

7. The antenna system of claim 1, wherein the first reflector reflects multiple incident signals.

8. The antenna system of claim 1, wherein the first reflective surface reflects the first signal to a first desired geographical area and the second reflective surface reflects the second signal to a second desired geographical area.

9. The antenna system of claim 8, wherein the first desired geographical area and the second desired geographical area are substantially equal.

10. The antenna system of claim 1, wherein the first signal and the second signal are linearly polarized.

11. The antenna system of claim 1, wherein the first signal and the second signal are orthogonally linearly polarized.

12. A method of broadcasting a signal, comprising the steps of:

reflecting from a single effective surface an incident signal from a signal source, the incident signal comprising a first polarized signal and a second polarized signal;

receiving the reflected incident signal at a reflector comprising a first reflective surface and a second reflective surface;

reflecting the first polarized signal from the first reflective surface; and reflecting the second polarized signal from the second reflective surface.

13. The method of claim 12, wherein the single surface of the first reflector is substantially ellipsoid in shape.

14. The method of claim 12, wherein the single surface of the first reflector is substantially hyperboloid in shape.

15. The method of claim 12, wherein the first reflector reflects multiple incident signals.

16. The method of claim 12, wherein the first reflective surface reflects the first signal to a first desired geographical area and the second reflective surface reflects the second signal to a second desired geographical area.

17. The method of claim 12, wherein the first signal and the second signal are linearly polarized.

18. The method of claim 12, wherein the first signal and the second signal are orthogonally linearly polarized.

19. A signal broadcast from a satellite, formed by performing the steps of:

reflecting an incident signal from a signal source, the incident signal comprising a first signal having a first polarization and a second signal having a second polarization;

receiving the reflected incident signal at a reflector comprising a first reflective surface and a second reflective surface;

reflecting the first signal from the first reflective surface; and reflecting the second polarized signal from the second surface.

20. An antenna system, comprising:

a first reflector for reflecting an incident signal from a signal source, the incident signal comprising a first signal having a first polarization and a second signal having a second polarization, the first reflector having a first surface that reflects the first signal and a second surface that reflects the second signal; and a second reflector for receiving the reflected incident first signal and the reflected incident second signal from the first reflector and for reflecting the received reflected incident signals, wherein the second reflector comprises a reflective surface for reflecting the reflected incident first signal and for reflecting the reflected incident second signal.

21. An antenna system, comprising:

a first reflector for reflecting an incident signal from a signal source, the incident signal comprising a first signal having a first polarization and a second signal having a second polarization, the first reflector having a first surface that reflects the first signal and a second surface that reflects the second signal; and a second reflector for receiving the reflected incident first signal and the reflected incident second signal from the first reflector and for reflecting the received reflected incident signals, wherein the second reflector comprises a third reflective surface for reflecting the reflected incident first signal and a fourth reflected surface for reflecting the reflected incident second signal.

22. The antenna system of claim 21, wherein the third reflective surface reflects the reflected incident second signal and the fourth reflected surface reflects the reflected incident first signal.

* * * * *